United States Patent [19]

Leu

[11] Patent Number: 4,889,375

[45] Date of Patent: Dec. 26, 1989

[54] FIREPLACE TOOL

[76] Inventor: James M. Leu, 159 Thornhurst, Bolingbrook, Ill. 60439

[21] Appl. No.: 245,576

[22] Filed: Sep. 19, 1988

[51] Int. Cl.[4] ..... A47J 49/00

[52] U.S. Cl. ..... 294/10; 294/14; 294/61

[58] Field of Search ..... 294/2, 5, 9–11, 294/14, 15, 17, 19.1, 19.3, 23.5, 24, 26, 50.6, 51, 55.5, 61, 120, 125; 7/109, 114, 158, 159, 166

[56] References Cited

U.S. PATENT DOCUMENTS

| | | | |
|---|---|---|---|
| 86,828 | 2/1869 | Emerson | 294/17 |
| 622,094 | 3/1899 | Williams | 294/10 |
| 1,722,953 | 7/1929 | Cole | 294/10 |
| 1,981,491 | 11/1934 | Wolfe | 294/14 X |
| 2,286,387 | 6/1942 | Smith | 294/14 |
| 3,124,383 | 3/1964 | Cahan | 294/11 |

FOREIGN PATENT DOCUMENTS

| | | | |
|---|---|---|---|
| 62177 | 6/1955 | France | 294/17 |
| 132630 | 8/1951 | Sweden | 294/17 |
| 164929 | 9/1958 | Sweden | 294/17 |
| 371568 | 4/1932 | United Kingdom | 294/14 |

*Primary Examiner*—Johnny D. Cherry

*Attorney, Agent, or Firm*—Hill, VanSanten, Steadman & Simpson

[57] ABSTRACT

A fireplace tool comprising an elongated rod member having a handle grip on one end and a pointed poker formed on the other end and including a plurality of four-sided chisel members extending through the elongated rod at a portion near the poker end. Each chisel member includes a plurality of teeth formed along each edge defined by the four sides thereof. The teeth are formed by cut-outs in each edge. The chisel members are spaced approximately one-half inch apart and are aligned along the line axis of the elongated rod member. Further, the chisel members protrude either in equal amounts through the elongated rod member, or, in progressively increasing amounts commencing from the poker end.

9 Claims, 1 Drawing Sheet

FIREPLACE TOOL

BACKGROUND OF THE INVENTION

The present invention relates generally to fireplace tools and, more particularly, to a poker tool combining poker and claw features.

Fires in fireplaces usually consist of burning wood or logs. When a piece of wood or a log burns, the outside surface thereof chars, leaving a charred outside layer. The outer surface of the piece of wood or log thus becomes a relatively cooler charred surface. However, just beneath the surface, the wood or logs continues to burn relatively hotly.

In order to maintain a hot burning fire, or to revive smoldering embers, it is necessary to knock the charred surface loose so as to expose the more hotly burning inner surface. Therefore, it is necessary to employ a tool that is capable of chipping away at the surface of the wood or logs so as to remove the charred surface therefrom.

Additionally, in many fires, in order to adjust the burning of the pieces of wood or logs, it is necessary to move the burning wood or logs. Therefore, a tool is employed to push or tug at the burning wood pieces or logs to thereby adjust the position or positions thereof.

Tools for accomplishing the foregoing include the standard poker having an elongated rod having a handle at one end and a pointed end at the other and a curved hook portion near the poker end. Another type of poker includes an elongated rod having a handle at one end and simply a pointed end having a tetrahedral shape, each face of which has a substantially triangular shape.

SUMMARY OF THE INVENTION

The present invention provides a device that includes members for poker actions, chipping or chiseling actions, and clawing actions. To this end, the invention provides a tool for a fireplace or stove that includes an elongated rod member having a poker end and chisel action members extending perpendicularly to the elongated rod and positioned near the poker end. A grip attached at the other end of the rod provides a point at which a user can grasp the tool. The chisel members include four-sided chisels having pointed ends and having teeth formed along the edges defined by the sides.

In one embodiment, the chisel members protrude from the rod in equal lengths. In another embodiment, the chisel members protrude from the rod in progressive amounts commencing the poke ends.

DETAILED DESCRIPTION OF THE PREFERRED EMBODIMENTS

Figure 1:
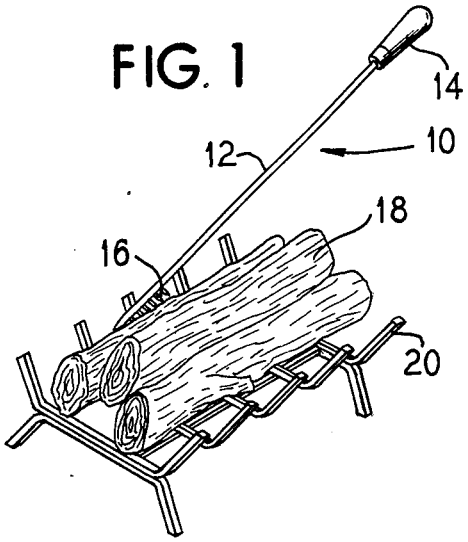
FIG. 1 is a perspective view of a fireplace tool embodying principles of the invention illustrating at least one use in connection with logs positioned on a fireplace grate.
Figure 2:
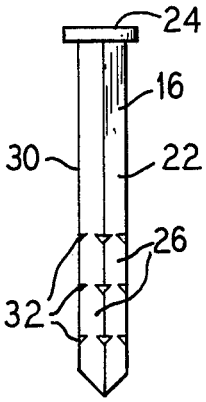
FIG. 2 is an elevational view of a chisel element utilized in forming the tool of FIG. 1.
Figure 3:
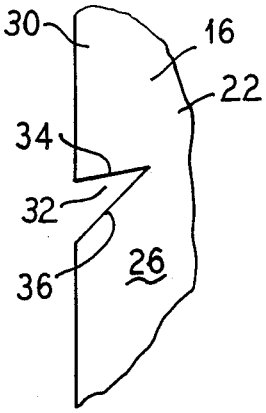
FIG. 3 is an enlarged fragmentary view of a chisel edge of the chisel of FIG. 2.

Illustrated in FIG. 1 is a fireplace tool 10 embodying prinicples of the invention. As illustrated, the tool 10 includes an elongated rod or bar member 12. At a handle end of the elongated bar or rod member 12 is attached a grip member 14. The grip member 14 is used by a user to grasp the tool 10. At the other end of the elongated rod 12, there are located a plurality of chisel members 16 that enable manipulation of the logs 18 on the grate 20.

The fireplace tool 10 is illustrated in more detail in FIGS. 2–5. Therein, it can be seen that each chisel member 16 includes a body portion 22 and a head portion 24. The body portion 22 has an elongated shape along the axis of which are formed a plurality of faces 26. The intersection of these faces 26 form knife edges 30. The head portion 24 is located on one end of the body portion 22, while the opposite end of the body portion is formed so as to have a pointed shape.

Along the edges 30 are formed a plurality of cut-outs or notches 32. As illustrated, each of the notches 32 is formed so as to have an upper planar face 34 and a lower planar face 36. As illustrated most clearly in FIG. 3, in profile, the planes defined by the faces 34 and 36 form an acute angle. The cut-outs 32 thus form a plurality of teeth or serrations along the edges 30 that are especially adapted for chipping away the charred surface around a log or piece of wood.

The edges 30 of the chisel members are roughly square but the edges 30 are smoothed somewhat so as to not be sharp to minimize sticking to the logs or wood when used. This reduces dangers that might arise when the chisel members inadvertently stick to a burning log or piece of wood.

Figure 4:
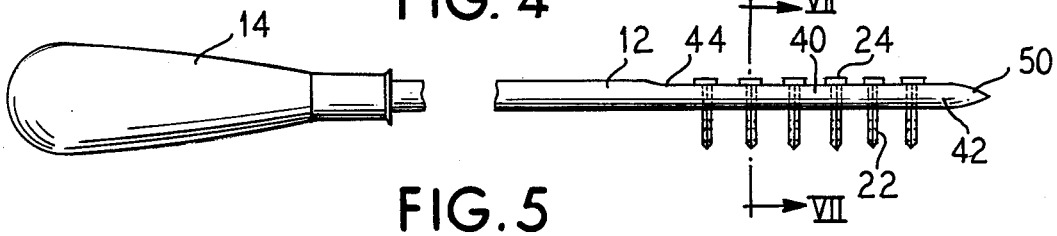
FIG. 4 is a side view of the tool of FIG. 1.
Figure 5:
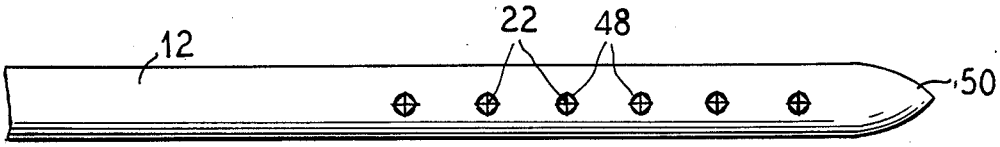
FIG. 5 is a bottom view of the tool of FIG. 1.

As illustrated most clearly in FIG. 4, the elongated rod portion includes a front portion 40 for receiving the chisel members 16. The front portion 40 includes a reduced diameter portion 42 wherein a portion of the front portion 40 of the elongated rod member 12 has been removed. By removing this portion, a flat surface 44 is formed on the front portion 40 for receiving the head portions 24 of the chisel members 16. The depth of the removed portion is roughly equal to the height of the head portions 24 of the chisel members 16.

As further illustrated, the front portion 40 of the elongated rod member 12 includes a pointed tip 50. This pointed tip provides the traditional poker function for the tool 10.

Additionally illustrated, the grip member 14 is attached at the handle end of the elongated rod. The grip member 14 may be of any standard type suitable for the purpose. In the illustrated embodiment, the grip member 14 is of the forced fit type wherein the grip member 14 is secured on the elongated bar member 12 by shear force fitting of the grip member 14 onto one end of the rod member.

Figure 7:
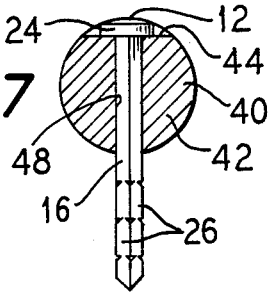
FIG. 7 is a cross-sectional view of the tool of FIG. 4 taken along the line VII—VII.

The chisel members 16 are inserted through openings 48, illustrated in FIG. 7, in the front portion 40 of the elongated rod member 12 that are spaced appooximately one-half inch apart. In the illustrated embodiment, the chisel members 16 are arranged in a straight line and are six in number. Further, the chisel members 16 protrude approximately one-half inch to five-eighths inch through the elongated rod member 12. These protrusions and spacings of the chisel members 16 are especially adapted for convenient chipping and manipulation of the logs 18. Further, the spacing of the chisel members is designed to facilitate the movement of common-sized wood pieces or logs used in residential fireplaces and stoves.

Figure 6:
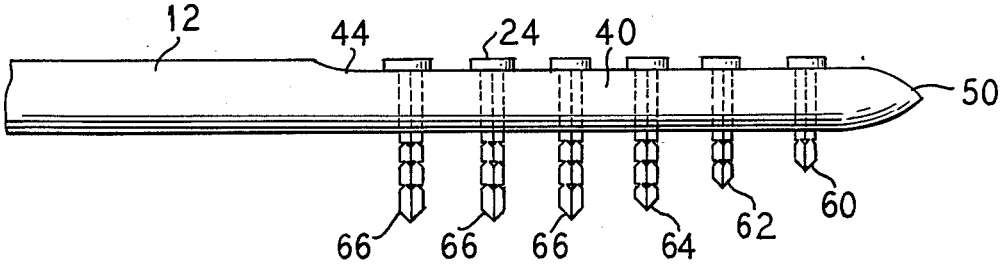
FIG. 6 is a fragmentary view of another fireplace tool embodying further principles of the invention.

In FIG. 6, there is illustrated an alternate embodiment of the invention, wherein the elongated rod member 12 includes chisel members 60, 62, 64, 66 that do not all protrude through the elongated rod member by the same amount. As illustrated, the three chisel members 66 furthest removed from the pointed end 50 of the elongated rod member 12 protrude by the same amount. The remaining chisel members 60, 62, 64 protrude by progressively decreasing amounts toward the pointed end 50 of the elongated rod member 12.

In the preferred embodiment, the fireplace tool is approximately 22 inches in length from the pointed end 50 to an end of the grip member 14. The length accommodates most residential fireboxes. The elongated rod member 12 is preferably made of steel and is seven-sixteenths of an inch in diameter.

It can be appreciated that the fireplace tool 10 can be utilized in a variety of ways. First, the pointed end of the chisel members 16 can be used to dig into the surfaces of pieces of wood or logs so that the tool 10 can be used to push or pull the logs or pieces of wood to thereby adjust the positions thereof. Thus, the tool serves as a claw of sorts.

Second, the edges 30 of the chisel members 16 can be used to chip away the outside surfaces of burning logs or pieces of wood, as described above, to remove the charred surfaces thereof to thereby expose the burning surfaces thereunder. Thus, the tool 10 serves as a scrapper of sorts.

Third, the pointed tip 50 of the tool 10 can be used to push or poke burning logs or pieces of wood. Thus, the tool 10 serves as a poker as well. Additionally, when the embodiment wherein the chisel members protrude in varying amounts through the elongated rod is utilized, the tool is especially adapted for pushing burning substances due to the contoured profile of the chisel members. It can be appreciated that the contoured profile prevents sticking of the chisel members to the burning wood and permits more than one pointed end of the chisel members to contact the wood for improved pushing action.

Fourth, the right angle formed by the pointed tip 50 and the first chisel member 16 from the tip can be utilized for pushing logs or pieces of wood. The pointed tip 50 and chisel member 16 provide two elements that are positionable on different portions of a log or piece of wood and thus, provide great stability during the pushing action.

While a preferred embodiment has been shown, modifications and changes may become apparent to those skilled in the art which shall fall within the spirit and scope of the invention. It is intended that such modifications and changes be covered by the attached claims.

I claim as my invention:

1. A fireplace tool, comprising:

an elongated rod member having a handle end and a pointed poker end;

a grip member received on said handle end; and a plurality of chisel members received in openings near said poker end, said chisel members being secured within said openings and having body portions protruding through said elongated rod member, each of said chisel members including a plurality of planar faces formed thereon along the length of the body portion, said faces intersecting to form edges extending along an axial length of the body portion, said body portion terminating in a point; and a plurality of teeth formed in each edge of each body portion of each chisel member, each tooth comprising a portion cut-out from said edge.

2. A fireplace tool as set forth in claim 1, wherein each chisel member protrudes by an equal amount.

3. A fireplace tool member as set forth in claim 1, wherein said chisel members protrude through said elongated rod member in varying amounts, said chisel members protruding progressively in increasing amounts commencing from said poker end.

4. A fireplace tool member as set forth in claim 1, where said chisel members are aligned along an axis of said elongated rod member, said chisel members being spaced about one-half inch apart.

5. A fireplace tool, comprising:

(a) an elongated rod member having a poker end and a handle end;

(b) a grip member attached at said handle end of said elongated rod member;

(c) a pointed poker formed at said poker end of said elongated rod member;

(d) a plurality of chisel members received in openings in said rod member and said poker end, said chisel members protruding through said elongated rod member, said chisel members being aligned along an axis of said elongated rod member, each of said chisel members comprising a four sided spike having a pointed end extending through said elongated rod member and having edges formed at corners of said sides and a plurality of teeth formed in each edge by a plurality of cut-outs in each edge.

6. A fireplace tool as set forth in claim 5, wherein said chisel members protrude through said elongated rod member in an equal amount.

7. A fireplace tool as set forth in claim 5, wherein said chisel members protrude in progressively increasing amounts through said elongated rod member commencing from the poker end.

8. A device, comprising:

an elongated rod;

means for providing a grip attached at a handle end of the rod;

means for poking formed at a poker end of said rod;

means for chipping and clawing a charred surface off from an ember provided near said poker end and comprising a plurality of rigid four-sided chisel members extending through said rod and perpendicularly thereto, wherein said chisel members include a plurality of teeth formed along intersections of said sides.

9. A device as set forth in claim 8, wherein said chisel members include a pointed end.

* * * * *